US010634135B2

(12) United States Patent
Elder et al.

(10) Patent No.: US 10,634,135 B2
(45) Date of Patent: Apr. 28, 2020

(54) REDUCTION OF CAVITATION IN GEAR PUMPS

(71) Applicant: Hamilton Sundstrand Corporation, Charlotte, NC (US)

(72) Inventors: James S. Elder, South Windsor, CT (US); Peter A. T. Cocks, South Glastonbury, CT (US); Marios C. Soteriou, Middletown, CT (US); Xiaoyi Li, Farmington, CT (US)

(73) Assignee: HAMILTON SUNSTRAND CORPORATION, Charlotte, NC (US)

( * ) Notice: Subject to any disclaimer, the term of this patent is extended or adjusted under 35 U.S.C. 154(b) by 278 days.

(21) Appl. No.: 15/631,973

(22) Filed: Jun. 23, 2017

(65) Prior Publication Data

US 2018/0372091 A1 Dec. 27, 2018

(51) Int. Cl.
*F04C 2/08* (2006.01)
*F04C 2/18* (2006.01)

(52) U.S. Cl.
CPC ..... *F04C 2/088* (2013.01); *F04C 2/084* (2013.01); *F04C 2/18* (2013.01); *F04C 2210/1044* (2013.01)

(58) Field of Classification Search
CPC ..... F04C 2/088
See application file for complete search history.

(56) References Cited

U.S. PATENT DOCUMENTS 1,129,090 A * 2/1915 Hawley ..... F04C 2/088 418/189
3,145,661 A * 8/1964 Marietta ..... F04C 2/088 418/102
9,874,208 B2 * 1/2018 Veilleux, Jr. ..... F04C 2/18
10,260,501 B2 * 4/2019 Shook ..... F04C 2/18
2012/0219449 A1 8/2012 Ni et al.
2015/0147211 A1 5/2015 Czerwonka
2016/0369795 A1 * 12/2016 Vacca ..... F04C 2/086
2017/0198693 A1 7/2017 Ribarov et al.

FOREIGN PATENT DOCUMENTS

EP 0769104 B1 9/1999

OTHER PUBLICATIONS

Extended European Search Report for Application No. 18179640.0-1004; Report dated Nov. 6, 2018; Report Received Date: Nov. 14, 2018; 8 pages.

* cited by examiner

*Primary Examiner* — Mary Davis
(74) *Attorney, Agent, or Firm* — Cantor Colburn LLP

(57) ABSTRACT

A fluid gear pump comprising: a first gear including a concentrically disposed first hub portion and a plurality of first teeth; a second gear including a concentrically disposed second hub portion and a plurality of second teeth, wherein at a time in operation the plurality of first teeth and second teeth contact at first and second contact point to create a backlash volume; a first bearing abutting and coaxial to first hub portion; a second bearing abutting and coaxial to second hub portion; and a bridgeland connecting the first and second bearing, the bridgeland separates a low pressure side from a high pressure side, the bridgeland is located such that the backlash volume closes to the high pressure side and opens to the low pressure side when a rate of change of a volume measurement of the backlash volume is decreasing or about equal to zero.

17 Claims, 7 Drawing Sheets

REDUCTION OF CAVITATION IN GEAR PUMPS

BACKGROUND

The subject matter disclosed herein generally relates to the field of gear pumps, and more particularly to an apparatus and method for reducing cavitation in gear pumps.

In one example of a gear pump, aircraft gas turbine engines receive pressurized fuel from gear-type fuel pumps. The gear pump typically performs over a wide operational speed range while providing needed fuel flows and pressures for various engine performance functions.

Gear pumps often comprise two coupled gears of similar configuration and size that mesh with each other inside an enclosed gear housing. A drive gear may be connected rigidly to a drive shaft. As the drive gear rotates, it meshes with a driven gear thus rotating the driven gear. As the gears rotate within the housing, fluid is transferred from an inlet to an outlet of the gear pump. Typically, the drive gear carries the full load of the gear pump drive or input shaft. The two gears may operate at high loads and high pressures, which may stress the gear teeth.

For given gear sizes the volume of fluid pumped through the gear pump may partially depend on the geometry of the tooth (e.g., depth, profile, etc.), the tooth count, and the width of the gear. Larger volumetric output may be achieved when lower gear tooth counts with large working tooth depths and face width are used. Alternatively, higher volumetric output may be achieved with higher rotational speed of the pump. Most gear pumps have gears with about ten to sixteen teeth. As the gears rotate, individual parcels of fluid are released between the teeth to the outlet. A common problem with more traditional gear pumps operating at high rotational speeds is cavitation erosion of the surfaces of the gear teeth and bearings. Cavitation erosion results in pitting of surfaces of the gear teeth that may eventually result in degraded pump volumetric capacity and affect pump operability and durability.

BRIEF SUMMARY

According to one embodiment, a fluid gear pump is provided. The fluid gear pump comprises: a first gear constructed and arranged to rotate about a first axis, the first gear including a concentrically disposed first hub portion and a plurality of first teeth radially projecting and circumferentially spaced about the first hub portion; a second gear operably coupled to the first gear for rotation about a second axis, the second gear including a concentrically disposed second hub portion and a plurality of second teeth radially projecting and circumferentially spaced about the second hub portion, wherein at a time in operation the plurality of first teeth and the plurality of second teeth contact at first contact point and a second contact point to create a backlash volume interposed between the first contact point and the second contact point; a first bearing abutting and coaxial to the first hub portion; a second bearing abutting and coaxial to the second hub portion; and a bridgeland connecting the first bearing to the second bearing, the bridgeland being configured to separate a low pressure side of the fluid gear pump from a high pressure side of the fluid gear pump and periodically seal fluid within the backlash volume in a direction parallel with the first axis; wherein the bridgeland is substantially shaped to follow a curvature of the teeth creating the backlash volume without intersecting a line of action from the first contact point to the second contact point.

In addition to one or more of the features described above, or as an alternative, further embodiments may include where the plurality of first teeth include a first leading tooth and a first trailing tooth adjacent to the first leading tooth; the plurality of second teeth include a second leading tooth and a second trailing tooth adjacent to the second leading tooth; the first contact point is between the first leading tooth and the second leading tooth; and the second contact point is between the first trailing tooth and the second trailing tooth.

In addition to one or more of the features described above, or as an alternative, further embodiments may include where the bridgeland further comprises: a first side extending from the second bearing to the first bearing, the first side including: a first segment substantially following a curvature of the second leading tooth extending from the second bearing to the first contact point, a second segment is substantially parallel with the line of action extending from the first contact point until overlapping a curvature of the first leading tooth, and a third segment substantially following a curvature of the first leading tooth from the second segment to the first bearing; and a second side extending from the first bearing to the second bearing, the second side including: a first segment substantially following a curvature of the first trailing tooth extending from the first bearing to the second contact point, a second segment is substantially parallel with the line of action extending from the second contact point until overlapping a curvature of the second trailing tooth, and a third segment substantially following the curvature of the second trailing tooth from the second segment of the second side to the second bearing.

In addition to one or more of the features described above, or as an alternative, further embodiments may include where the first leading tooth in operation loses contact with the second leading tooth at the first contact point when a rate of change of a volume measurement of the backlash volume is decreasing or about equal to zero.

In addition to one or more of the features described above, or as an alternative, further embodiments may include where the first trailing tooth in operation contacts with the second trailing tooth at the second contact point when a rate of change of a volume measurement of the backlash volume is decreasing or about equal to zero.

In addition to one or more of the features described above, or as an alternative, further embodiments may include where the bridgeland is located such that the backlash volume closes to the high pressure side and opens to the low pressure side when a rate of change of a volume measurement of the backlash volume is decreasing or about equal to zero.

In addition to one or more of the features described above, or as an alternative, further embodiments may include where the fluid gear pump is a fuel pump.

In addition to one or more of the features described above, or as an alternative, further embodiments may include where the first gear is a driving gear and the second gear is a driven gear.

According to another embodiment, a fluid gear pump is provided. The fluid gear pump comprising: a first gear constructed and arranged to rotate about a first axis, the first gear including a concentrically disposed first hub portion and a plurality of first teeth radially projecting and circumferentially spaced about the first hub portion; a second gear operably coupled to the first gear for rotation about a second axis, the second gear including a concentrically disposed second hub portion and a plurality of second teeth radially projecting and circumferentially spaced about the second hub portion, wherein at a time in operation the plurality of first teeth and the plurality of second teeth contact at first contact point and a second contact point to create a backlash volume interposed between the first contact point and the second contact point; a first bearing abutting and coaxial to the first hub portion; a second bearing abutting and coaxial to the second hub portion; and a bridgeland connecting the first bearing to the second bearing, the bridgeland being configured to separate a low pressure side of the fluid gear pump from a high pressure side of the fluid gear pump and periodically seal fluid within the backlash volume in a direction parallel with the first axis; wherein the bridgeland is located such that the backlash volume closes to the high pressure side and opens to the low pressure side when a rate of change of a volume measurement of the backlash volume is decreasing or about equal to zero.

In addition to one or more of the features described above, or as an alternative, further embodiments may include where the bridgeland is substantially shaped to follow a curvature of the teeth creating the backlash volume without intersecting a line of action from the first contact point to the second contact point.

In addition to one or more of the features described above, or as an alternative, further embodiments may include where the plurality of first teeth include a first leading tooth and a first trailing tooth adjacent to the first leading tooth; the plurality of second teeth include a second leading tooth and a second trailing tooth adjacent to the second leading tooth; the first contact point is between the first leading tooth and the second leading tooth; and the second contact point is between the first trailing tooth and the second trailing tooth.

In addition to one or more of the features described above, or as an alternative, further embodiments may include where the bridgeland further comprises: a first side extending from the second bearing to the first bearing, the first side including: a first segment substantially following a curvature of the second leading tooth extending from the second bearing to the first contact point, a second segment is substantially parallel with the line of action extending from the first contact point until overlapping a curvature of the first leading tooth, and a third segment substantially following a curvature of the first leading tooth from the second segment to the first bearing; and a second side extending from the first bearing to the second bearing, the second side including: a first segment substantially following a curvature of the first trailing tooth extending from the first bearing to the second contact point, a second segment is substantially parallel with the line of action extending from the second contact point until overlapping a curvature of the second trailing tooth, and a third segment substantially following the curvature of the second trailing tooth from the second segment of the second side to the second bearing.

In addition to one or more of the features described above, or as an alternative, further embodiments may include where the first leading tooth in operation loses contact with the second leading tooth at the first contact point when a rate of change of a volume measurement of the backlash volume is decreasing or about equal to zero.

In addition to one or more of the features described above, or as an alternative, further embodiments may include where the first trailing tooth in operation contacts with the second trailing tooth at the second contact point when a rate of change of a volume measurement of the backlash volume is decreasing or about equal to zero.

In addition to one or more of the features described above, or as an alternative, further embodiments may include where the fluid gear pump is a fuel pump.

In addition to one or more of the features described above, or as an alternative, further embodiments may include where the first gear is a driving gear and the second gear is a driven gear.

According to another embodiment, a method of reducing cavitation during fluid gear pump operation is provided. The method comprising: rotating a first gear around first axis, the first gear including a concentrically disposed first hub portion and a plurality of first teeth radially projecting and circumferentially spaced about the first hub portion; rotating a second gear coupled to the first gear about a second axis, the second gear including a concentrically disposed second hub portion and a plurality of second teeth radially projecting and circumferentially spaced about the second hub portion, wherein the plurality of first teeth engage the plurality of second teeth to create a backlash volume interposed between the plurality of first teeth and plurality of second teeth when rotating; transferring fluid from a low pressure side to a high pressure side when the first gear is rotating and the second gear is rotating; closing the backlash volume to the high pressure side when a rate of change of a volume measurement of the backlash volume is decreasing or about equal to zero; and opening the backlash volume to the low pressure when the rate of change of the volume measurement of the backlash volume is decreasing or about equal to zero.

In addition to one or more of the features described above, or as an alternative, further embodiments may include where the backlash volume is closed using a bridgeland.

In addition to one or more of the features described above, or as an alternative, further embodiments may include where the backlash volume is opened using a bridgeland.

Technical effects of embodiments of the present disclosure include shaping and locating the bridgeland to reduce cavitation, while also timing the gear teeth meshing to further control cavitation.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

Figure 5A:
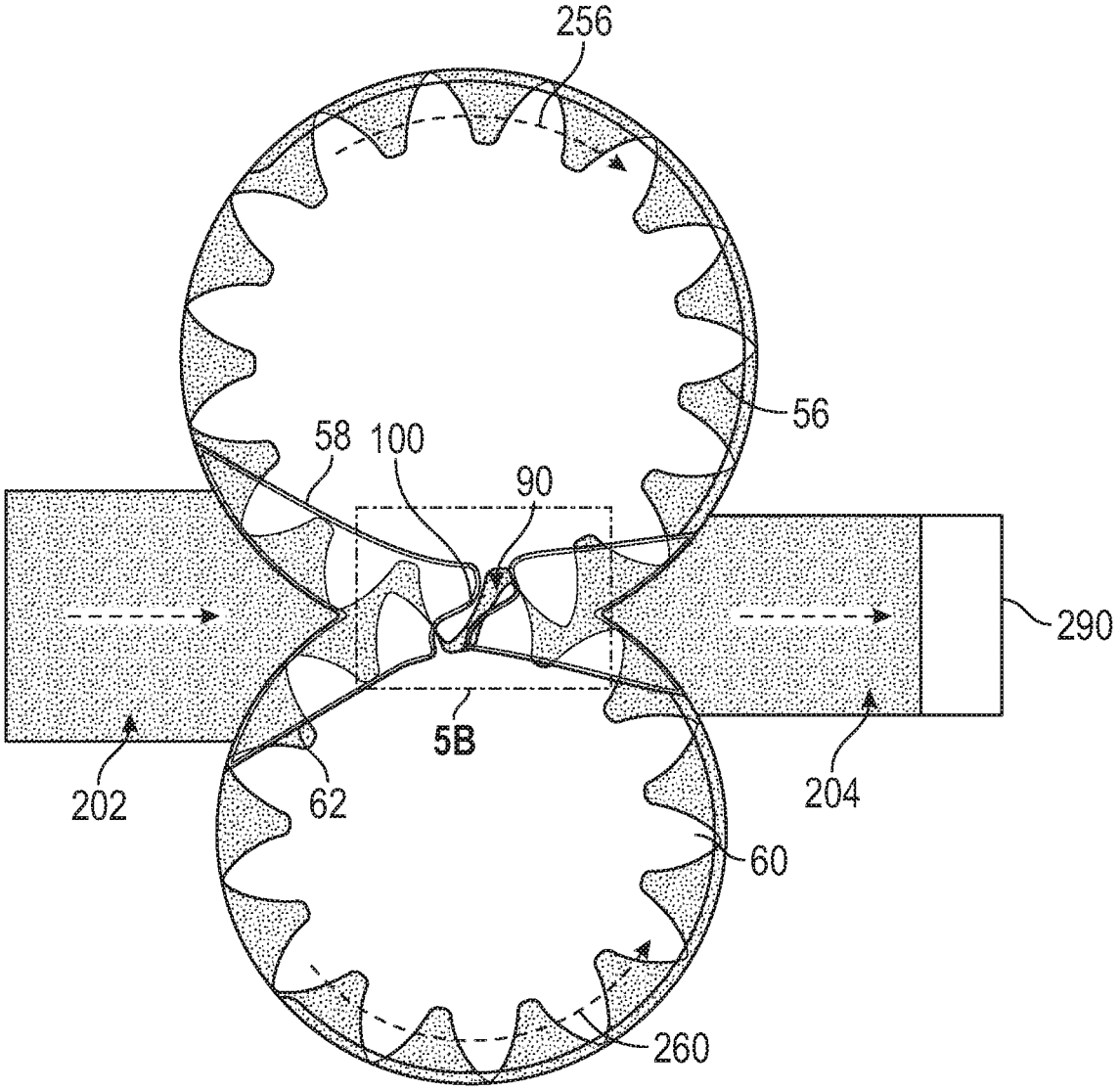
Figure 5B:
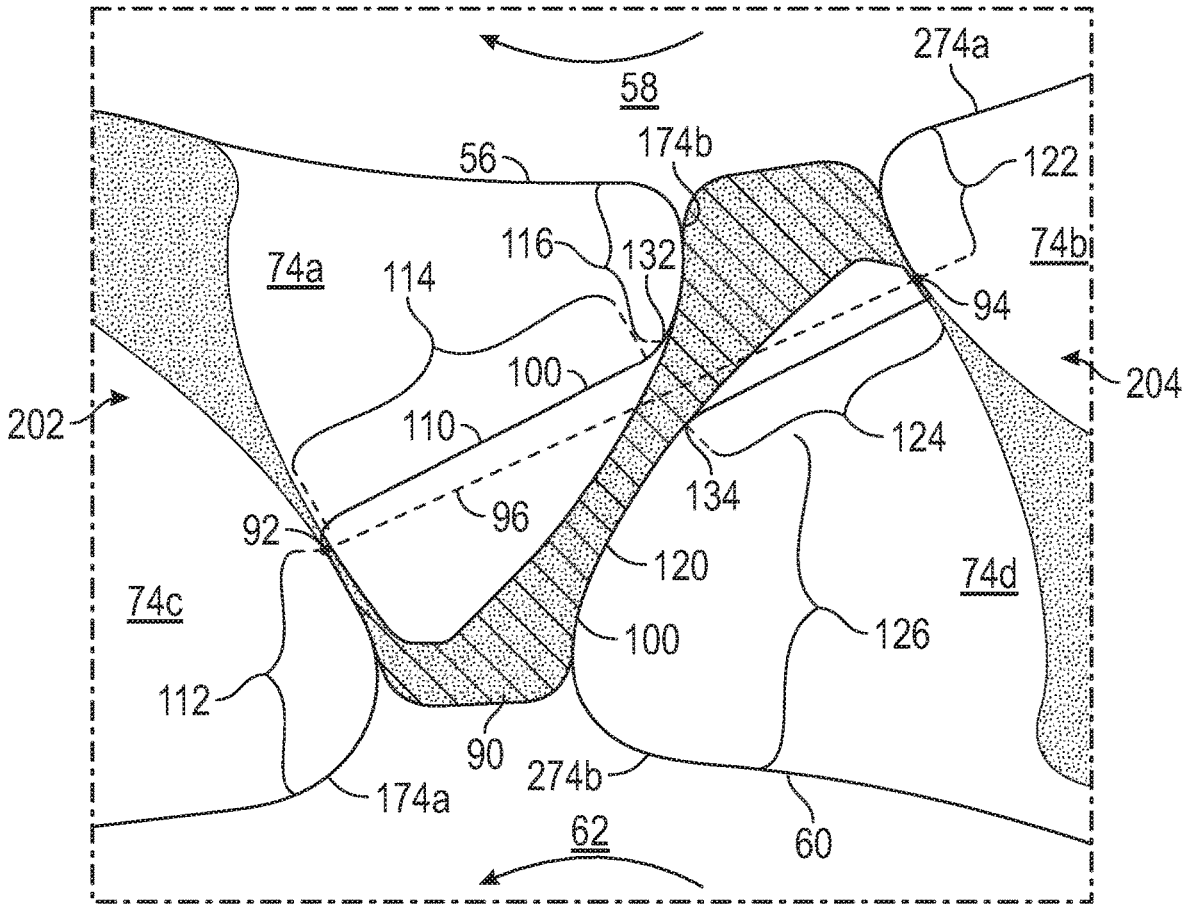
Figure 5C:
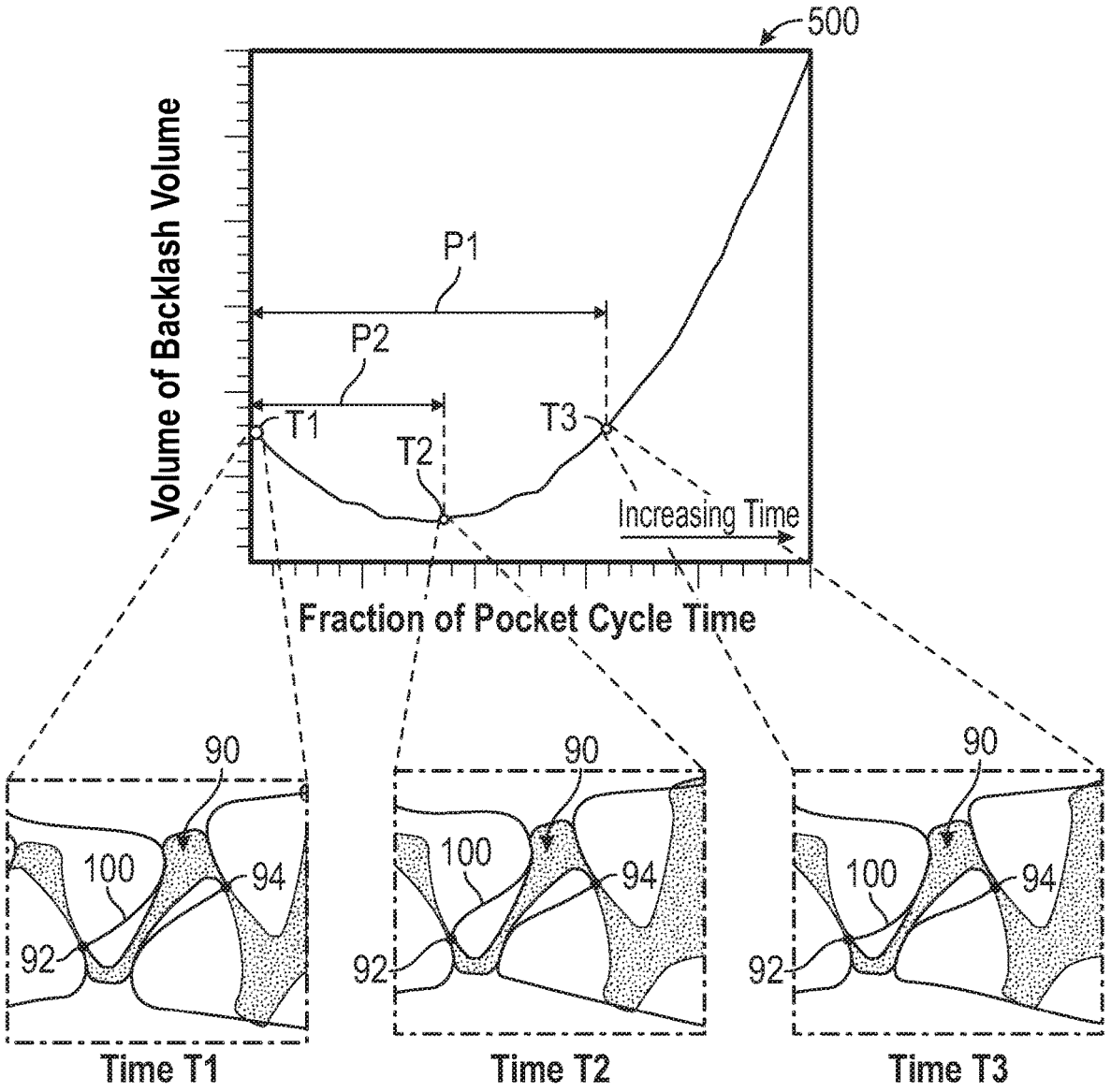
Figure 6:
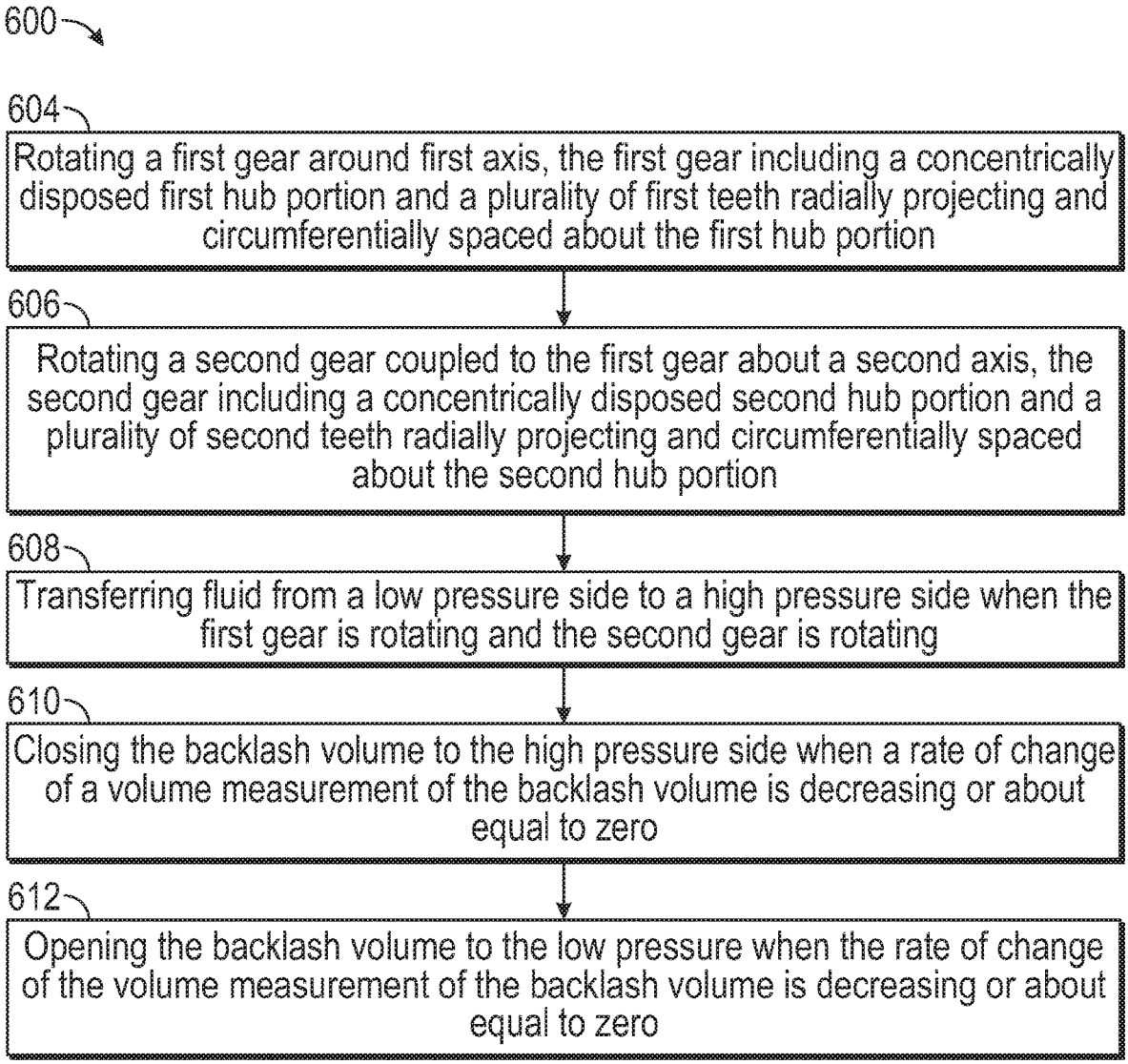

FIGS. 5*a*, 5*b*, and 5*c* illustrate a schematic view of coupled gears with a bridgeland overlaid and a backlash volume overlaid, in accordance with an embodiment of the disclosure; and FIG. 6 illustrates a flow diagram illustrating a method of reducing cavitation during fluid gear pump operation, in accordance with an embodiment of the disclosure.

DETAILED DESCRIPTION

A detailed description of one or more embodiments of the disclosed apparatus and method are presented herein by way of exemplification and not limitation with reference to the Figures.

Various embodiments of the present disclosure are related to the reduction of fluid cavitation within gear pumps. Aircraft engine high pressure fuel pumps typically use a pair of involute gears to generate fuel pressure for the burner injectors. These gears are enclosed in a housing within which they are supported by bearings. In the vicinity of the gear meshing region these bearings form a bridgeland that separates the high and low pressure regions and maintains high pump efficiency. A pump of this description experiences significant pressure oscillations that may lead to the formation and subsequent collapse of cavitation bubbles that may cause material damage. The gears, supporting bearings, and enclosing housing are all susceptible to cavitation damage that results in a deterioration of pump performance and can significantly reduce the useable life of these components. This is particularly relevant in the region of the bridgeland which amplifies local pressure oscillations through a periodic sealing of the trapped volume between the interlocking gear teeth (backlash volume). The geometrical features of the bridgeland sealing surface have a strong influence on cavitation damage. To address these issues some designs introduce leaks through the gear intermeshing region that mitigate the magnitude of local pressure oscillations at the expense of reduced pump efficiency.

Embodiments disclosed herein seek to address a method of designing the bridgeland geometry to seal the pump high-pressure discharge from the low-pressure inlet in such a way that cavitation damages are minimized and/or eliminated without relying on undesirable leaks. Advantageously, this methodology will (i) reduce formation of bubbles due to cavitation and reduce the severity of their collapse, thus minimizing cavitation damage; (ii) optimize the fluid filling and venting in the gear meshing region such that erosion due to fluid dynamical processes is minimized, and (iii) ensure that there is no direct leak between high and low pressure sides so that pump efficiency is not compromised.

Figure 1:
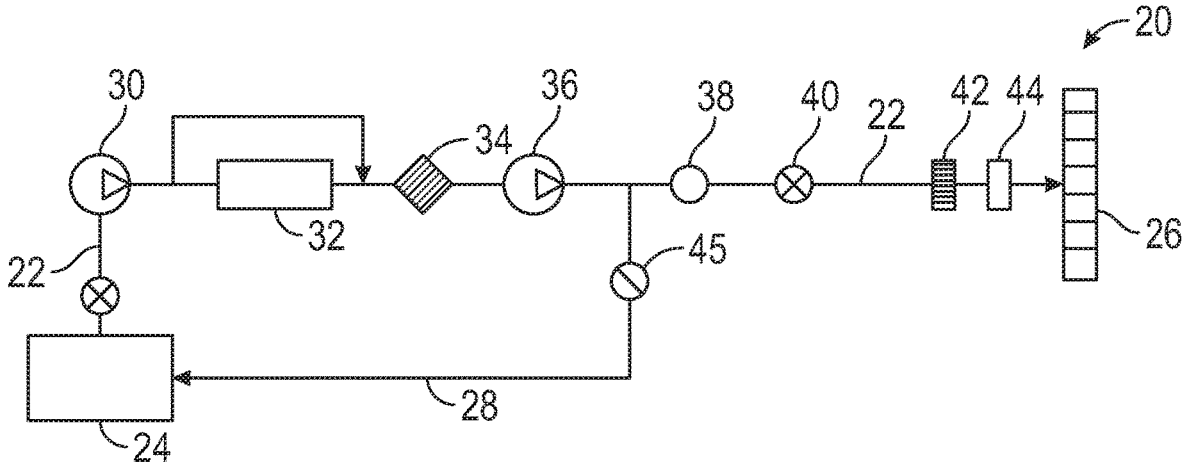
FIG. 1 illustrates a schematic of an aircraft fuel system as one, non-limiting, example of an application of a gear pump of the present disclosure.

Referring to FIG. 1, one embodiment of a fuel system 20 of the present disclosure is illustrated. The fuel system 20 may be an aircraft fuel system and may include a fuel supply line 22 that may flow liquid fuel from a fuel tank 24 to fuel nozzles 26 of an engine (not shown). A fuel bypass line 28 may be arranged to divert fuel from the supply line 22 and back to the fuel tank 24. Various fuel system components may interpose the fuel supply line 22 and may include a low pressure fuel pump 30, a heat exchanger 32, a fuel filter 34, a high pressure fuel pump 36, a metering valve 38, a high pressure fuel shutoff valve 40, a screen 42, a fuel flow sensor 44, and a fuel tank shutoff valve 45. The low pressure fuel pump 30 may be located downstream of the fuel tank 24. The heat exchanger 32 may be located downstream of the low pressure fuel pump 30. The fuel filter 34 may be located downstream of the heat exchanger 32. The high pressure fuel pump 36 may be located downstream of the fuel filter 34 and upstream of the fuel bypass line 28. The metering valve 38 may be located downstream from the bypass line 28. The high pressure fuel shutoff valve 40 may be located downstream from the bypass line 28. The screen 42 may be located downstream from the high pressure fuel shutoff valve 40, and the fuel flow sensor 44 may be located downstream from the screen 42. It is further contemplated and understood that other component configurations of a fuel system are applicable and may further include additional sensors, valves and other components.

The heat exchanger 32 may be adapted to use the flowing fuel as a heat sink to cool other liquids flowing from any variety of auxiliary systems of an aircraft and/or the engine. For example, the heat exchanger 32 may transfer heat from an oil and to the fuel. The oil may be used to lubricate any variety of auxiliary components including, for example, a gear box (not shown) of the engine. Such a transfer of heat may elevate the temperature of the fuel which may make the high pressure fuel pump 36 more prone to cavitation.

Figure 2:
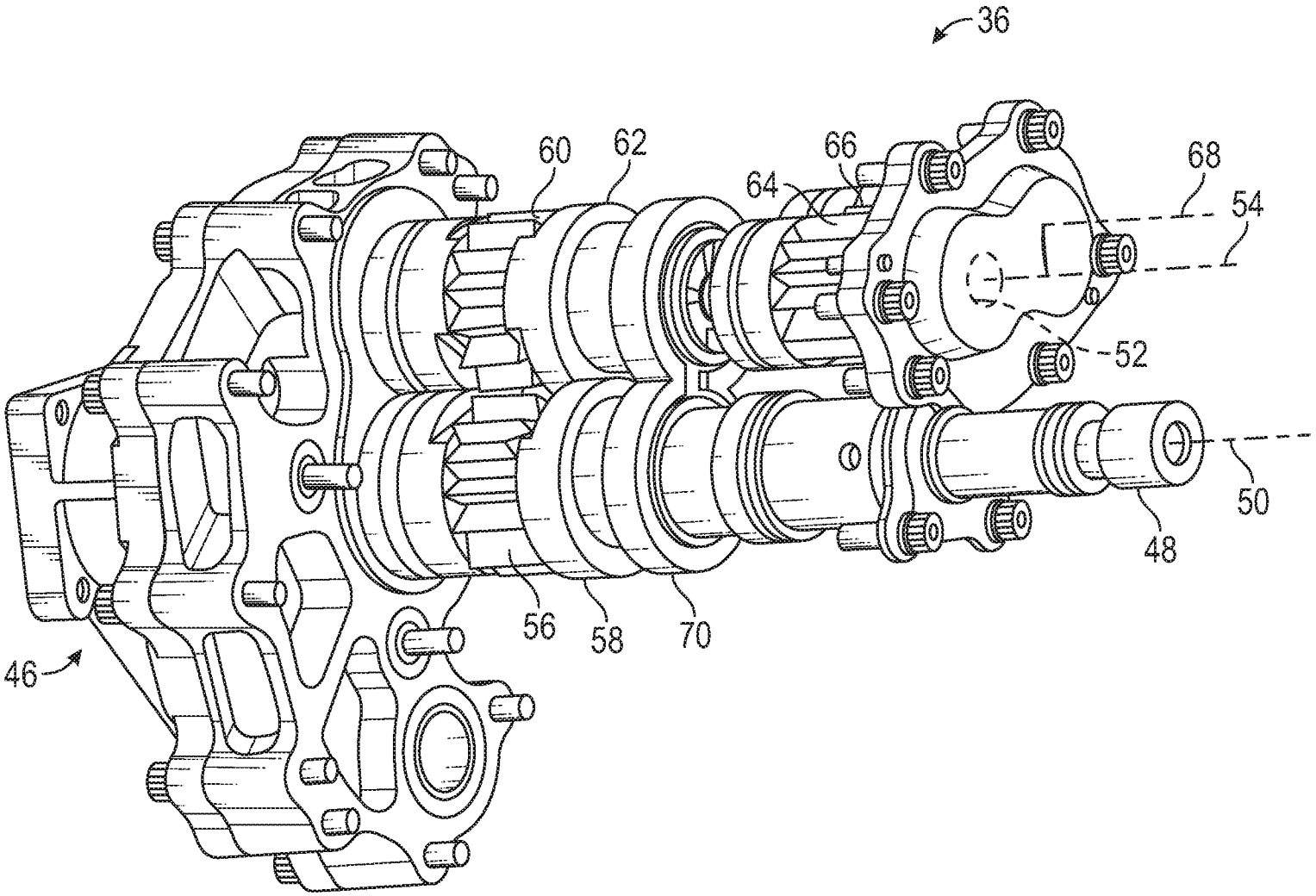
FIG. 2 illustrates a perspective view of the gear pump with a housing removed to show internal detail.
Figure 3:
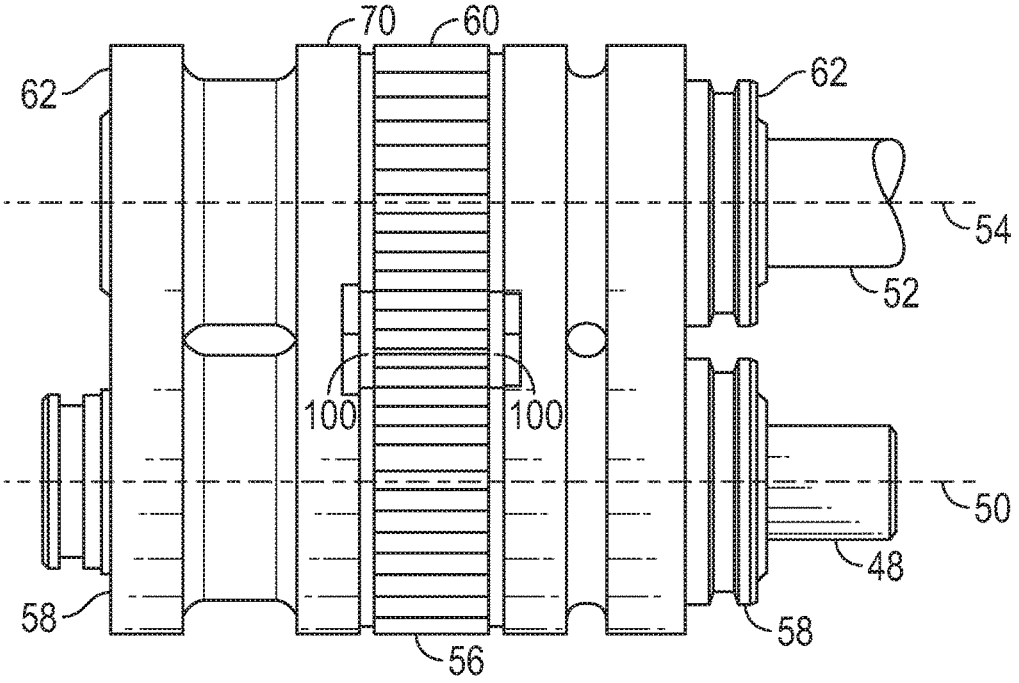
FIG. 3 illustrates a side view of coupled gears and associated bearings of the gear pump.

Referring to FIGS. 2 and 3, one non-limiting example of the high pressure fuel pump 36 is illustrated as a gear pump with a housing removed to show internal detail. The gear pump 36 may be a dual stage pump and may include an fuel centrifugal boost pump housing 46, an input drive shaft 48 constructed for rotation about a first axis 50, a coupling shaft 52 constructed for rotation about a second axis 54, a drive gear 56 with associated bearings 58, a driven gear 60 with associated bearings 62, a motive drive gear 64 and a motive driven gear 66 configured for rotation about a third axis 68. The axis 50, 54, 68 may be substantially parallel to one-another. The drive shaft 48 may attach to an engine gear box (not shown). The drive gear 56 is engaged and concentrically disposed to the drive shaft 48. The driven gear 60 and motive drive gear 64 are engaged and concentrically disposed to the coupling shaft 52. The drive and driven gears 56, 60 are rotationally coupled to one another for the pumping (i.e., displacement) of fuel as a first stage, and the motive drive gear 64 and motive driven gear 66 are rotationally coupled to one another for the continued pumping of the fuel as a second stage. It is further contemplated and understood that many other types of gear pumps may be applicable to the present disclosure. For example, the gear pump may be a single stage gear pump, and/or the drive shaft 48 may be attached to any other device capable of rotating the drive shaft 48 (e.g., electric motor).

The bearings 58, 62 may be inserted into a common carrier 70 that generally resembles a figure eight. A gear bearing face geometry, known in the art as a bridgeland 100 may be sculpted to minimize cavitation and pressure ripple that may deteriorate the integrity of the pump components, discussed further below. The bridgeland 100 separates a low pressure side 202 and a high pressure side 204 (see FIGS. 5*a*-5*c*) of the pump 36 and periodically provides sealing of a backlash volume 90 (see FIGS. 5*a*-5*c*) in a direction parallel with the first axis 50 and/or the second axis 54.

In operation, the gear pump 36 is capable of providing fuel at a wide range of fuel volume/quantity and pressures for various engine performance functions. The engine gearbox provides rotational power to the drive shaft 48 which, in-turn, rotates the connected drive gear 56. The drive gear 56 then drives (i.e., rotates) the driven gear 60 that rotates the coupling shaft 52. Rotation of the coupling shaft 52 rotates the motive drive gear 64 that, in-turn, rotates the motive driven gear 66.

Figure 4:
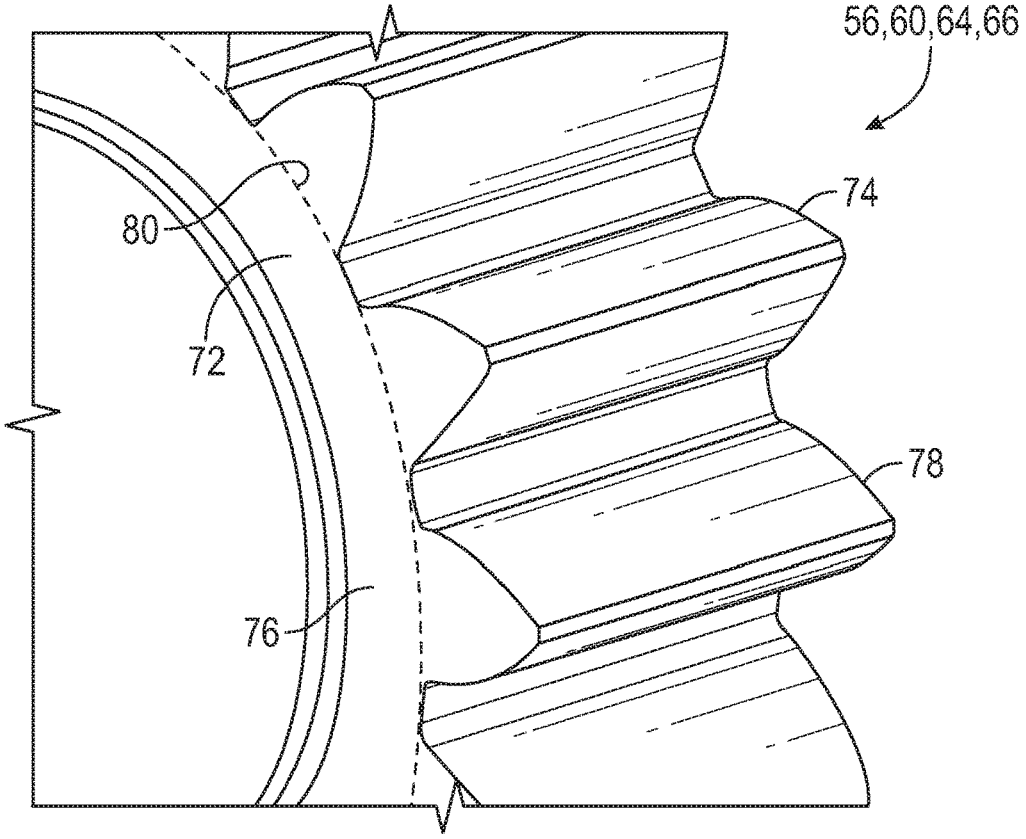
FIG. 4 illustrates a partial perspective view of one of the coupled gears.

Referring to FIG. 4, each of the gears 56, 60, 64, 66, may include a hub portion 72 and a plurality of teeth 74 that may both span axially between two opposite facing sidewalls 76, 78. Each sidewall 76, 78 may lay within respective imaginary planes that are substantially parallel to one-another. The hub portion 72 may be disc-like and projects radially outward from the respective shafts 48, 52 and/or axis 50, 54, 68 to a circumferentially continuous face 80 generally carried by the hub portion 72. The face 80 may generally be cylindrical. The plurality of teeth 74 project radially outward from the face 80 of the hub portion 72 and are circumferentially spaced about the hub portion 72. The gears 56, 60, 64, 66 may be spur gears, helical gears or other types of gears with meshing teeth, and/or combinations thereof.

Referring to FIGS. 5*a*, 5*b*, and 5*c* with continued references to FIGS. 1-4. For the description of FIGS. 5*a*, 5*b*, and 5*c*, the drive gear 56 may be referred to as a first gear 56 having a plurality of first teeth including a first leading tooth 74*a* and a first trailing tooth 74*b*. As seen in FIG. 5*b*, the first trailing tooth 74*b* is adjacent the first leading tooth 74*a* on the first gear 56. The first leading tooth 74*a* advances ahead in rotation of the first trailing tooth 74*b*. Also for the description of FIGS. 5*a* and 5*b*, the driven gear 60 may be referred to as a second gear 60 having a plurality of second teeth including a second leading tooth 74*c* and a second trailing tooth 74*d*. As seen in FIG. 5*b*, the second trailing tooth 74*d* is adjacent the second leading tooth 74*c* on the second gear 60. The second leading tooth 74*c* advance in rotation ahead of the second trailing tooth 74*d*.

As seen in FIG. 5*a*, the first gear 56 is rotating in a clockwise direction and driving the second gear 60 to rotate in a counter-clockwise direction. The clockwise rotation of the first gear 56 transfers fluid around the first gear 56 as shown by arrow 256 and counter-clockwise rotation of the second gear 60 transfers fluid around the second gear 60 as shown by arrow 260, thus transferring fluid from a low pressure side 202 to a high pressure side 204. Located on the high pressure side, downstream of this fluid flow, a fluid regulating device 290 may assist in building up the pressure on the high pressure side 204. When the first gear 56 and the second gear 60 begin to mesh, fluid is pushed out from between the gears towards the high pressure side, however a small amount of fluid may remain in the backlash volume 90, discussed further below. The fluid in the backlash volume 90 is transported back over to the low pressure side 202 after first gear 56 and second gear 60 disengage.

As seen in FIG. 5*b*, at a time in operation the plurality of first teeth 74*a*, 74*b* and the plurality of second teeth 74*c*, 74*d* contact at a first contact point 92 and a second contact point 94 to create a backlash volume 90 interposed between the first contact point 92 and the second contact point 94. In the embodiment of FIG. 5*b*, at that time in operation the first leading tooth 74*a* is in contact with the second leading tooth 74*c* at the first contact point 92 and the first trailing tooth 74*b* is in contact with the second trailing tooth 74*d* to create the backlash volume 90 interposed between the first contact point 92 and the second contact point 94. As seen in FIG. 5*b*, a line of action 96 exists from the first contact point 92 to the second contact point 94. The line of action 96 shows the direction of force passing from the first gear 56 to the second gear 60 at that moment in time.

Also seen in FIG. 5*b* overlaid over the gears 56, 60 is a first bearing 58 and a second bearing 62. The first bearing 58 is abutting and coaxial to the first hub portion (not shown) of the first gear 56. The second bearing 62 is abutting and coaxial to the second hub portion (not shown) of the second gear 60. The first bearing 58 is connected to the second bearing 62 through a bridgeland 100. The bridgeland 100 is configured to separate a low pressure side 202 of the fluid gear pump 36 from a high pressure side 204 of the fluid gear pump 36 and periodically seal fluid within the backlash volume 90 when the contacts points 92, 94 are in contact. The bridgeland 100 provides sealing a direction parallel with the first axis 50 and/or the second axis 54. The bridgeland 100 is substantially shaped to follow a curvature of the teeth 74*a-d* creating the backlash volume 90 without intersecting a line of action 96 from the first contact point 92 to the second contact point 94. Advantageously, shaping the bridgeland 100 to substantially follow the curvature of the teeth 74*a-d* allows for the efficient filling and evacuating of the backlash volume, thus optimizing the fluid filling and venting in the gear meshing region such that erosion due to fluid dynamical processes is minimized and/or reduced.

The bridgeland 100 is composed of a first side 110 and a second side 120. The first side 110 extends from the second bearing 62 to the first bearing 58. The first side 110 may include three connected segments 112, 114, 116. The first segment 112 of the first side 110 substantially follows a curvature 174*a* of the second leading tooth 74*c* extending from the second bearing 62 to the first contact point 92. The second segment 114 of the first side 110 is substantially parallel with the line of action 96 extending from the first contact point 92 until overlapping a curvature 132 of the first leading tooth 74*a*. The third segment 116 of the first side substantially follows a curvature 174*b* of the first leading tooth 74*a* from the second segment 114 to the first bearing 58.

The second side 120 extends from the first bearing 58 to the second bearing 62. The second side 120 may also include three connected segments 122, 124, 126. The first segment 122 of the second side 120 substantially following a curvature 274*a* of the first trailing tooth 74*b* extending from the first bearing 58 to the second contact point 94. The second segment 124 of the second side 120 is substantially parallel with the line of action 96 extending from the second contact point 94 until overlapping a curvature 134 of the second trailing tooth 74*d*. The third segment 126 of the second side 120 substantially follows the curvature 274*b* of the second trailing tooth 74*d* from the second segment 124 of the second side 120 to the second bearing 62.

During operation of the fuel system 20 as one example, aircraft fuel may be heated by the heat exchanger 32 to temperatures as high as about 300° F. (149° C.) at pressures that may reach 300 psi (2.07 MPa). This heated fuel may enter the high pressure pump 36 and is further increased in pressure (at a controlled flow) via the un-meshing and re-meshing of the teeth 74 of the coupled gears 56, 60 and or gears 64, 66. The shape of the bridgeland 100 may help minimize cavitation and pressure ripple that may occur when the fuel flashes into a vapor phase during meshing of the teeth 74 and the resulting vapor bubbles collapse onto the gear and bearing surfaces as the pressure rises. Benefits of the present disclosure include a reduction or elimination of cavitation near a surface of the gear teeth 74 and/or bearing surfaces through the bridgeland 100 shaping and location with respect to the backlash volume 90.

In a first embodiment, the first leading tooth 74*a* in operation contacts the second leading tooth 74*c* at the first contact point 92 about simultaneously to when the first trailing tooth 74*b* contacts the second trailing tooth 74*d* at the second contact point 94. In a second embodiment, the first trailing tooth 74*b* in operation contacts the second trailing tooth 74*d* at the second contact point 94 prior to the first leading tooth 74*a* loosing contact with the second leading tooth 74*c* at the first contact point 92. The presence of two contact points 92, 94 forms a backlash volume 90. In the first and second embodiments described immediately prior, the bridgeland 100 defines when the backlash volume 90 closes to the high pressure side 204 and opens to the low pressure side 202. The present disclosure describes a bridgeland 100 that closes the backlash volume 90 to the high pressure side 204 before opening the backlash volume 90 to the low pressure side 202. Advantageously timing the opening of the backlash volume 90 to the low pressure side 202 and the closing of the backlash volume 90 to high pressure side 204 in such a way that there is no direct communication between the sides 202, 204 helps to eliminate leaks and increase pump efficiency.

In an embodiment, the first trailing tooth 74*b* in operation contacts with the second trailing tooth 74*d* at the second contact point 94 about simultaneous to the first leading tooth 74*a* loosing contact with the second leading tooth 74*c* at the first contact point 92, thus minimizing the time period that the backlash volume 90 is sealed. Advantageously, minimizing the time period that the backlash volume 90 is sealed minimizes the period when low pressures are experienced and cavitation takes place.

In an embodiment, the bridgeland 100 location/timing causes the backlash volume 90 to close to the high pressure side 204 and open to the low pressure side 202 when a rate of change of a volume measurement of the backlash volume 90 is about equal to zero. Advantageously, linking the timing for sealing (closing and opening) of the backlash volume 90 to the magnitude and rate of change of volume measurement of the backlash volume 90 minimizes the magnitude of pressure oscillations in the backlash volume 90 and the formation and collapse of cavitation bubbles. This volume measurement initially decreases and then increases during the gear interlocking period thus experiencing a minimum at one point (i.e. a rate of change equal to about zero). In an embodiment, the opening and closing is designed to occur near this minimum when rate of change is close to zero. It is noted that sealing the volume during the period when the backlash volume 90 is decreasing (i.e. prior to the minimum) may provide additional benefits from a cavitation perspective since no low pressures can be experienced and no cavitation will be manifested. However, due to the fact that the liquid in the backlash volume 90 is being compressed during this period, bridgeland 100 designs that attempt to exploit this feature may be prone to pressure spikes. Thus, it is advantageous to avoid locating the bridgeland 100 in an area overlaying the gear teeth 74 such that the backlash volume 90 closes to the high pressure side 204 and opens to the low pressure side 202 where the volume measurement of the backlash volume 90 is decreasing. It is advantageous to locate the bridgeland 100 overlaying the gear teeth 74 in such a way that it can seal and unseal the backlash volume 90 near a region where the volume measurement of the backlash volume 90 is the smallest and experiences smallest variations.

As seen in FIG. 5*c* a graph 500 is shown illustrating a volume measurement of the backlash volume 90 over a period of time along with a bridgeland designed for three separate times T1, T2, T3. T1 corresponds to the time when two contact points 92, 94 first exist and T3 corresponds to the final time when two contact points 92, 94 exist. Therefore the backlash volume 90 only exists between times T1 and T3 (during period P1). FIG. 5*c*-1 shows a bridgeland 100 design that closes the backlash volume 90 to the high pressure side 204 and opens the backlash volume 90 to the low pressure side 202 at time T1. FIG. 5*c*-2 shows a bridgeland 100 design that closes the backlash volume 90 to the high pressure side 204 and opens the backlash volume 90 to the low pressure side 202 at time T2. FIG. 5*c*-3 shows a bridgeland 100 design that closes the backlash volume 90 to the high pressure side 204 and opens the backlash volume 90 to the low pressure side 202 at time T3. Although the bridgeland 100 designs showing in FIG. 5*c* simultaneously close and open the backlash volume 90, it is understood that the opening of the backlash volume 90 may occur before the closing of the backlash volume 90, or the closing of the backlash volume 90 may occur before the opening of the backlash volume. It is advantageous to close the backlash volume 90 to the high pressure side 204 before opening the backlash volume 90 to the low pressure side 202 to avoid leaks and decreases in pump performance FIGS. 5*c*-1, 5*c*-2, and 5*c*-3, show that the location (timing) of the bridgeland 100 relative to the gear teeth 74 and backlash volume 90 may be changed while still meeting the shape requirements discussed above in regard to FIG. 5*b*.

The bridgeland 100 design in FIG. 5*c*-1, may be susceptible to pressure spikes since it is located on the bearing such that the sealing (closing and opening) of the backlash volume 90 occurs when the volume measurement of the backlash volume 90 is decreasing. The bridgeland 100 design in FIG. 5*c*-3 may be susceptible to cavitation since it is located on the bearing such that the sealing (closing and opening) of the backlash volume 90 occurs when the volume measurement of the backlash volume 90 is increasing. The volume measurement of the backlash volume 90 is decreasing for period P2, after which the volume measurement starts to increase again. FIG. 5*c*-2 shows the optimal timing, when sealing (closing and opening) of the backlash volume 90 occurs about when the rate of change of volume measurement of the backlash volume 90 is equal to zero.

As seen in FIG. 5C, the volume of the backlash volume 90 decreases from time T1 to time T2 and then the volume of the backlash volume 90 increases from time T2 to time T3. At time T2 the rate of change of the volume of the backlash volume 90 is about zero. In an embodiment, the bridgeland 100 may be located to seal the backlash volume when a rate of change of a volume measurement of the backlash volume is decreasing or about equal to zero, thus at a time between T1 and T2 or about T2. Thus, the closing of the backlash volume 90 and the opening of the backlash volume 90 by the bridgeland 100 occurs when the rate of change of the volume measurement of the backlash volume 90 is about equal to zero. In another embodiment, the bridgeland 100 may be located to seal the backlash volume when a rate of change of a volume measurement of the backlash volume is decreasing, as shown by the second time period P2 between time T1 and T2. Advantageously, locating the bridgeland 100 to seal at T2 or any time during the second time period P2 prevents the volume of the backlash volume 90 is increasing, which reduces the amount of cavitation.

Referring now to FIG. 6, with continued reference to FIGS. 1-5. FIG. 6 shows a flow chart of method 600 of reducing cavitation during fluid gear pump operation, in accordance with an embodiment of the disclosure. At block 604, a first gear 56 is rotated around first axis 50. The first gear 56 includes a concentrically disposed first hub portion 72*a* and a plurality of first teeth radially projecting and circumferentially spaced about the first hub portion 72*a*. At block 606, a second gear 60 coupled to the first gear 56 is rotated about a second axis. The second gear 60 includes a concentrically disposed second hub portion and a plurality of second teeth radially projecting and circumferentially spaced about the second hub portion. The plurality of first teeth 74*a*, 74*b* engage the plurality of second teeth 74*c*, 74*d* to create a backlash volume 90 interposed between the plurality of first teeth 74*a*, 74*b* and plurality of second teeth 74*c*, 74*d* when rotating.

At block 608, fluid is transferred from a low pressure side 202 to a high pressure side 204 when the first gear 56 is rotating and the second gear 60 is rotating. The fluid gets captured in the gear teeth 74 and is transferred from the low pressure side 202 to the high pressure side 204 as shown by arrow 256 and arrow 260 in FIG. 5*a*. At block 610, the backlash volume 90 closes to the high pressure side 204 when a rate of change of a volume measurement of the backlash volume 90 is decreasing or about equal to zero. At block 612, the backlash volume 90 opens to the low pressure 202 when the rate of change of the volume measurement of the backlash volume 90 is decreasing or about equal to zero. Advantageously, by opening and closing the backlash volume when the rate of change of a volume measurement of the backlash volume 90 is about equal to zero helps prevent cavitation bubbles from occurring by avoiding the drastic changes in pressure that result from significant volume changes under sealed conditions.

While the above description has described the flow process of FIG. 6 in a particular order, it should be appreciated that unless otherwise specifically required in the attached claims that the ordering of the steps may be varied.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A fluid gear pump comprising:

a first gear constructed and arranged to rotate about a first axis, the first gear including a concentrically disposed first hub portion and a plurality of first teeth radially projecting and circumferentially spaced about the first hub portion;

a second gear operably coupled to the first gear for rotation about a second axis, the second gear including a concentrically disposed second hub portion and a plurality of second teeth radially projecting and circumferentially spaced about the second hub portion, wherein at a time in operation the plurality of first teeth and the plurality of second teeth contact at first contact point and a second contact point to create a backlash volume interposed between the first contact point and the second contact point;

a first bearing abutting and coaxial to the first hub portion;

a second bearing abutting and coaxial to the second hub portion; and a bridgeland connecting the first bearing to the second bearing, the bridgeland being configured to separate a low pressure side of the fluid gear pump from a high pressure side of the fluid gear pump and periodically seal fluid within the backlash volume in a direction parallel with the first axis;

wherein the bridgeland is substantially shaped to follow a curvature of the first teeth and the second teeth creating the backlash volume without intersecting a line of action from the first contact point to the second contact point.

2. The fluid gear pump set forth in claim 1, wherein:

the plurality of first teeth include a first leading tooth and a first trailing tooth adjacent to the first leading tooth;

the plurality of second teeth include a second leading tooth and a second trailing tooth adjacent to the second leading tooth;

the first contact point is between the first leading tooth and the second leading tooth; and the second contact point is between the first trailing tooth and the second trailing tooth.

3. The fluid gear pump set forth in claim 2, wherein the bridgeland further comprises:

a first side extending from the second bearing to the first bearing, the first side including: a first segment substantially following a curvature of the second leading tooth extending from the second bearing to the first contact point, a second segment is substantially parallel with the line of action extending from the first contact point until overlapping a curvature of the first leading tooth, and a third segment substantially following a curvature of the first leading tooth from the second segment to the first bearing; and a second side extending from the first bearing to the second bearing, the second side including: a first segment substantially following a curvature of the first trailing tooth extending from the first bearing to the second contact point, a second segment is substantially parallel with the line of action extending from the second contact point until overlapping a curvature of the second trailing tooth, and a third segment substantially following the curvature of the second trailing tooth from the second segment of the second side to the second bearing.

4. The fluid gear pump set forth in claim 2, wherein the first leading tooth in operation loses contact with the second leading tooth at the first contact point when a rate of change of a volume measurement of the backlash volume is decreasing or about equal to zero.

5. The fluid gear pump set forth in claim 2, wherein the first trailing tooth in operation contacts with the second trailing tooth at the second contact point when a rate of change of a volume measurement of the backlash volume is decreasing or about equal to zero.

6. The fluid gear pump set forth in claim 2, wherein the bridgeland is located such that the backlash volume closes to the high pressure side and opens to the low pressure side when a rate of change of a volume measurement of the backlash volume is decreasing or about equal to zero.

7. The fluid gear pump set forth in claim 1, wherein the fluid gear pump is a fuel pump.

8. The fluid gear pump set forth in claim 1, wherein the first gear is a driving gear and the second gear is a driven gear.

9. A fluid gear pump comprising:

a first gear constructed and arranged to rotate about a first axis, the first gear including a concentrically disposed first hub portion and a plurality of first teeth radially projecting and circumferentially spaced about the first hub portion;

a second gear operably coupled to the first gear for rotation about a second axis, the second gear including a concentrically disposed second hub portion and a plurality of second teeth radially projecting and circumferentially spaced about the second hub portion, wherein at a time in operation the plurality of first teeth and the plurality of second teeth contact at first contact point and a second contact point to create a backlash volume interposed between the first contact point and the second contact point;

a first bearing abutting and coaxial to the first hub portion;

a second bearing abutting and coaxial to the second hub portion; and a bridgeland connecting the first bearing to the second bearing, the bridgeland being configured to separate a low pressure side of the fluid gear pump from a high pressure side of the fluid gear pump and periodically seal fluid within the backlash volume in a direction parallel with the first axis;

wherein the bridgeland is located such that the backlash volume closes to the high pressure side and opens to the low pressure side when a rate of change of a volume measurement of the backlash volume is decreasing or about equal to zero, and wherein the bridgeland is substantially shaped to follow a curvature of the first teeth and the second teeth creating the backlash volume without intersecting a line of action from the first contact point to the second contact point.

10. The fluid gear pump set forth in claim 9, wherein:

the plurality of first teeth include a first leading tooth and a first trailing tooth adjacent to the first leading tooth;

the plurality of second teeth include a second leading tooth and a second trailing tooth adjacent to the second leading tooth;

the first contact point is between the first leading tooth and the second leading tooth; and the second contact point is between the first trailing tooth and the second trailing tooth.

11. The fluid gear pump set forth in claim 10, wherein the bridgeland further comprises:

a first side extending from the second bearing to the first bearing, the first side including: a first segment substantially following a curvature of the second leading tooth extending from the second bearing to the first contact point, a second segment is substantially parallel with the line of action extending from the first contact point until overlapping a curvature of the first leading tooth, and a third segment substantially following a curvature of the first leading tooth from the second segment to the first bearing; and a second side extending from the first bearing to the second bearing, the second side including: a first segment substantially following a curvature of the first trailing tooth extending from the first bearing to the second contact point, a second segment is substantially parallel with the line of action extending from the second contact point until overlapping a curvature of the second trailing tooth, and a third segment substantially following the curvature of the second trailing tooth from the second segment of the second side to the second bearing.

12. The fluid gear pump set forth in claim 10, wherein the first leading tooth in operation loses contact with the second leading tooth at the first contact point when a rate of change of a volume measurement of the backlash volume is decreasing or about equal to zero.

13. The fluid gear pump set forth in claim 10, wherein the first trailing tooth in operation contacts with the second trailing tooth at the second contact point when a rate of change of a volume measurement of the backlash volume is decreasing or about equal to zero.

14. The fluid gear pump set forth in claim 9, wherein the fluid gear pump is a fuel pump.

15. The fluid gear pump set forth in claim 9, wherein the first gear is a driving gear and the second gear is a driven gear.

16. A method of reducing cavitation during fluid gear pump operation, the method comprising:

rotating a first gear around first axis, the first gear including a concentrically disposed first hub portion and a plurality of first teeth radially projecting and circumferentially spaced about the first hub portion;

rotating a second gear coupled to the first gear about a second axis, the second gear including a concentrically disposed second hub portion and a plurality of second teeth radially projecting and circumferentially spaced about the second hub portion, wherein the plurality of first teeth engage the plurality of second teeth to create a backlash volume interposed between the plurality of first teeth and plurality of second teeth when rotating;

transferring fluid from a low pressure side to a high pressure side when the first gear is rotating and the second gear is rotating;

closing the backlash volume to the high pressure side when a rate of change of a volume measurement of the backlash volume is decreasing add or about equal to zero; and opening the backlash volume to the low pressure when the rate of change of the volume measurement of the backlash volume is decreasing or about equal to zero, wherein the backlash volume is closed using a bridgeland, and wherein the bridgeland is substantially shaped to follow a curvature of the first teeth and the second teeth creating the backlash volume without intersecting a line of action from the first contact point to the second contact point.

17. The method of claim 16, wherein the backlash volume is opened using a bridgeland.

* * * * *